United States Patent [19]

Yan

[11] 4,423,008

[45] Dec. 27, 1983

[54] DIRECT ACID ELUTION OF ANIONIC EXCHANGE RESINS FOR RECOVERY OF URANIUM

[75] Inventor: Tsoung-Yuan Yan, Philadelphia, Pa.

[73] Assignee: Mobil Oil Corporation, New York, N.Y.

[21] Appl. No.: 352,288

[22] Filed: Feb. 25, 1982

Related U.S. Application Data

[63] Continuation-in-part of Ser. No. 80,627, Oct. 1, 1979, abandoned, and Ser. No. 327,543, Dec. 4, 1981, abandoned, which is a continuation of Ser. No. 80,627, Oct. 1, 1979, abandoned.

[51] Int. Cl.[3] ..... C01G 43/01

[52] U.S. Cl. ..... 423/7; 423/16; 210/682

[58] Field of Search ..... 423/7, 16; 75/101 BE; 210/682

[56] References Cited

U.S. PATENT DOCUMENTS

| | | | |
|---|---|---|---|
| 2,780,514 | 2/1957 | Lutz | 23/14.5 |
| 2,811,412 | 10/1957 | Poirier | 23/14.5 |
| 2,864,667 | 12/1968 | Bailes et al. | 23/14.5 |
| 2,982,605 | 5/1961 | Mouret et al. | 23/14.5 |
| 4,137,290 | 1/1979 | Degenkolb et al. | 423/1 |

OTHER PUBLICATIONS

Tame, K. E. "Alkaline Leach Processing . . . " USBM, TN 23.U7 No. 6409 US DOI Library, 1964.

Merritt, R. C., *The Extractive Metallurgy of Uranium*, Colo. Sch. of Mines Res. Inst., 1971, pp. 161–163 and 167–180.

*Primary Examiner*—Deborah L. Kyle

*Attorney, Agent, or Firm*—Alexander J. McKillop; James F. Powers, Jr.; John K. AboKhair

[57] ABSTRACT

A process as disclosed for recovering uranium values from a carbonate leach solution which comprises directly eluting a column of resin onto which uranium has been sorbed by flowing a concentrated acidic eluant through the column without preconditioning and/or post-conditioning the resin. The concentrated acidic eluant may be flowed upward or, preferably, downward through the column.

12 Claims, 3 Drawing Figures

FIGURE 2. SCHEMATIC OF ELUTION BY DOWNWARD FLOW
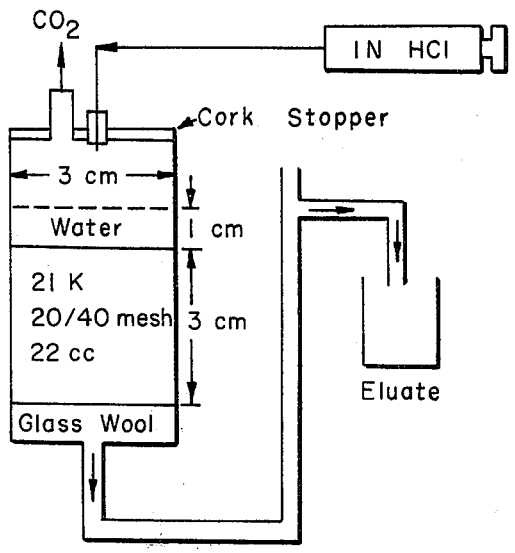

FIGURE 3. PH VS VOLUME OF ELUATE
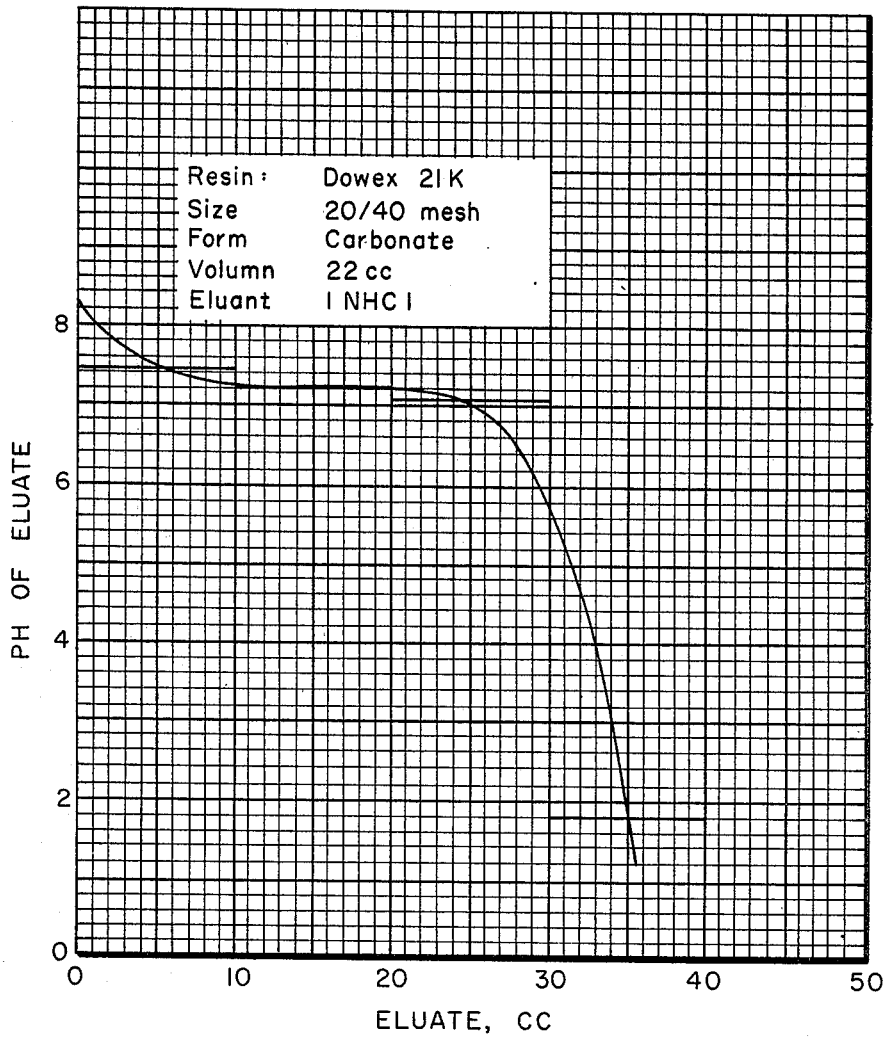

DIRECT ACID ELUTION OF ANIONIC EXCHANGE RESINS FOR RECOVERY OF URANIUM

RELATED APPLICATIONS

This application is a continuation-in-part of my application Ser. No. 327,543, filed Dec. 4, 1981, now abandoned, which in turn is a continuation of my application Ser. No. 080,627, filed Oct. 1, 1979, now abandoned. Additionally this application is a direct continuation-in-part of application Ser. No. 80,627, Oct. 1, 1979, now abandoned.

BACKGROUND OF THE INVENTION

The present invention relates to a method for acid eluting a uranyl carbonate-loaded, anionic exchange resin and more particularly, relates to a method for directly eluting a uranyl carbonate-loaded anionic resin with a concentrated acidic eluant without preconditioning and/or post conditioning the resin.

In a typical leach operation, a mineral bearing ore is contacted with a leach solution to dissolve the mineral values, e.g. uranium, from the ore. The uranium is then concentrated from the relatively dilute leach solution by passing the leach solution through an ion exchange medium which adsorbs the uranium from the leach solution. Where a carbonate solution is used as the leach solution, the uranium will exist in the leach solution in the form of uranyl carbonate complexes which exchange readily with strong basic anionic resins. In the majority of the known commerical leach operations of this type, these resins when sufficiently loaded with uranium are eluted with concentrated carbonate/bicarbonate solutions and/or chloride solutions, e.g. sodium or ammonium chloride.

Although acidic eluants would appear to offer many advantages in most leach operations, as far as known, they are not used in known commercial operations which utilize a carbonate leach solution. Previous known suggestions that acidic eluants could be used in carbonate leach operations also indicate that the loaded resin has to be first preconditioned before eluting with acidic eluant and/or that the resin has to be post-conditioned after elution before the resin undergoes its next loading cycle, see U.S. Pat. No. 2,811,412. Further, it is a commonly-held belief in the art, that the carbon dioxide which would be generated by directly eluting a uranyl carbonate-loaded resin with an acidic eluant could cause serious disruption of the ion exchange column operations and could cause rupture, and hence, destruction of the expensive resin beads; see Merritt, R. C.; THE EXTRACTIVE METALLURGY OF URANIUM, Colorado School of Mines Research Institute, 1971, page 161.

SUMMARY OF THE INVENTION

The present invention provides a method for directly eluting a quaternary amine resin; loaded with uranyl carbonate complex, with a concentrated acidic eluant without requiring pretreatment of the resin before elution or treatment of the resin after elution before the next loading cycle.

Specifically, a carbonate leach solution containing uranyl carbonate complex is flowed upward through a column containing a basic, anionic exchange resin, e.g. quaternary amine resin, which adsorbs the uranyl carbonate complex from the leach solution. When the resin is sufficiently loaded, the flow of leach solution is ceased and the resin is directly eluted with a concentrated acidic eluant, e.g. hydrochloric acid, without pretreatment of the loaded resin. The carbon dioxide generated during elution is vented from the top of the column or may be recovered for reuse in the leach process.

To elute the resin, the quantity of acid, i.e. $H^+$, required to elute all of the resin in the column is determined and this acid is then concentrated into the least possible practical volume of eluant. In practical application, the required quantity of acid is mixed into a water or other carrier fluids, e.g. recycled decant solution such as an aqueous solution of sodium chloride, to form a concentrated acidic eluant having an acid concentration of, preferably, at least 1 normal.

It should be understood, however, that acid concentrations on the order of 0.01 normal (i.e. pH approximately 2) or even lower are believed to be capable of stripping uranium from the resin in the column and that the use of acid solutions of such concentrations is within the scope of the invention.

The eluant containing eluted uranyl carbonate complex (i.e. the eluate) is flowed from the column and treated to precipitate the uranium values therefrom. The resin is now ready for another loading cycle without further treatment. Preferably the uranium values are precipitated from the eluate by adding an oxidizer, e.g. hydrogen peroxide, and adjusting the eluate's pH to somewhere in the range of 2 to 4 by adding sodium hydroxide. Upon precipitation of the uranium values, sodium chloride and water are formed which comprise the decant solution which can then be used as carrier fluid in making up fresh acidic eluant.

The present invention, by directly eluting a uranyl carbonate-loaded, quaternary amine resin with a concentrated acidic eluant, provides several real advantages over previous elution methods which used carbonate eluants to elute such resins. Acid elution provides (1) improved loading characteristics of the eluted resin; (2) improved resin stability, i.e. less loss of amine functional groups from the resin; (3) elimination of the acidification step in subsequent precipitation operations; (4) elimination of the problem of calcite formation on the resin; and (5) more complete elution of the uranyl carbonate complex from the resin. The actual operation and other apparent advantages of the present invention will be better understood by referring to the following detailed description.

BRIEF DESCRIPTION OF THE DRAWINGS

FIG. 2 is a schematic representation of the preferred form of acid elution, i.e. downward flow.

FIG. 3 graphically depicts one of the advantages of acid elution by downward flow, namely, low back mixing of the liquid flow through the column.

DETAILED DESCRIPTION OF THE DRAWINGS

Figure 1:
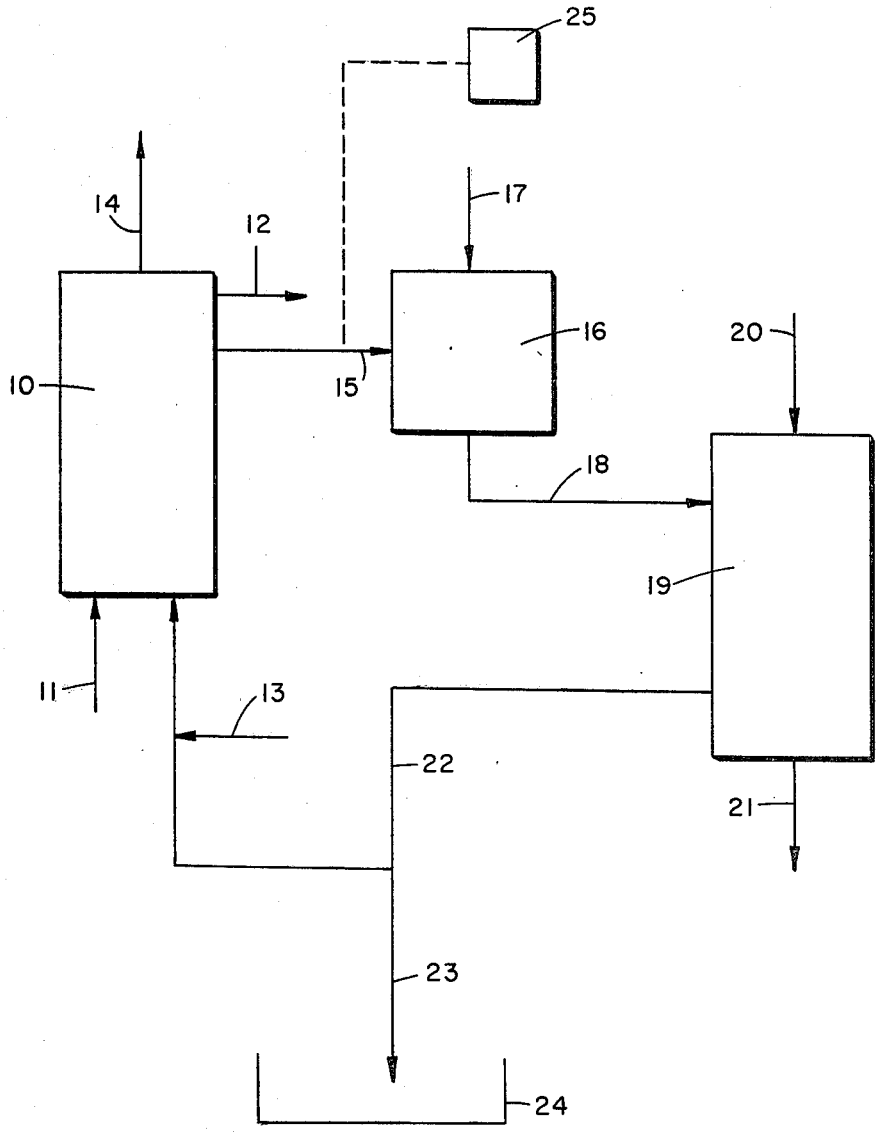
FIG. 1 is a schematical representation of a loading, elution, and precipitation section of a carbonate leach operation for recovering uranium values in which the present invention can be utilized.

More particularly FIG. 1 discloses a simplified schematic of the elution and precipitation circuit of a leach operation for recovering uranium from its ore. As is known, a carbonate leach solution (e.g. ammonium carbonate/bicarbonate) is passed through a uranium bearing ore (not shown) which dissolves the uranium from the ore as a uranyl carbonate complex. The pregnant leach solution, now carrying the dissolved uranyl carbonate complex is flowed into column 10 through line 11. Column 10 contains a strong basic anionic resin of the type commonly used in known carbonate leach operations to exchange the uranyl carbonate complex material from the leach solution. These resins are generally known as quaternary amine resins and there are several commercially available, e.g. IRA 430 manufactured by Rohm and Haas Company, Philadelphia, Pa. and Dowex 21K manufactured by Dow Chemical Company, Midland, Mich. The leach solution flows through column 10 and out line 12. When the resin in column 10 is sufficiently loaded with uranyl carbonate complex, the flow of leach solution is halted to column 10 and the resin is ready for elution.

In accordance with the present invention, the loaded basic anionic resin in column 10 is directly eluted with a concentrated acidic eluant without any pretreatment of the resin. Acid, preferably hydrochloric acid (HCl) having a concentration of, for example, one normal (1 N) or greater, is flowed from line 13 into line 14 and upward through the resin in column 10. The acidic eluant quickly reacts with the uranyl carbonate complexes, e.g. $UO_2(CO_3)_3^{-4}$ on the resin with an apparent reaction as follows:

$$R_4UO_2(CO_3)_3+6H^+ \rightarrow R_4^{+4}+UO_2^{+2}+3CO_2+3H_2O, \quad (1)$$

where R is the anionic resin.

The uranyl carbonate complexes are exchanged from the resin and decomposed irreversibly to generate carbon dioxide, i.e. $CO_2$ and uranyl cation, i.e. $UO_2^{+2}$. The uranyl cation is no longer exchangeable with anionic resin, rendering the elution effective. In other words, the elution is effected by decomposing the uranyl tricarbonate complex with acid to form uranyl cations that prevent back exchange and minimize the tailing.

A down-flow system is shown in FIG. 2. Thus, a 3 cm ID glass column was filled at its bottom with glass wool and then with 22 cc (3 cm bed height) of small Dowex 21K resin (20/40 mesh). The resin had been previously loaded with carbonate from solution containing 10 g/l of $NaHCO_3$, at pH 8.3. Water was then added to the level 1 cm above the resin bed, where the liquid level in the column was controlled by siphon action. To simulate acid elution, 1 N HCl eluant was pumped with a syringe pump at 60 cc/hr from the top. Both the flow of liquid and gas and the state of the resin bed were observed. The pH of the "eluate" was also recorded.

When the acid eluant was added from the top, $CO_2$ gas was formed within the resin bed. The $CO_2$ gas bubbles were small and carried the resin beads upward as they rose. The resin sank as the $CO_2$ bubbles broke from it. As more acid was added, this motion of gas and resin intensified, resulting in a gently elulating bed of resin. As a result, the mass transfers in the bed were promoted which could improve the elution operation.

The $CO_2$ gas was evolved from the vent on top of the column without interruption of the operation. The rate of 60 cc/hr of acid addition is equivalent to regeneration time of 30 min., which is much faster than that normally contemplated.

The liquid level was maintained by use of a siphon. A slight increase in water level was observed when gas rate was high due to the decreased column density.

Back mixing of the liquid flow through the column was low as indicated in FIG. 3 by a sharp drop in the pH of eluate. Low back-mixing of liquid is very desirable for achieving efficient elution.

It was quite surprising to find that acid elution in a down-flow column worked smoothly, i.e, that it provided low liquid back-mixing resulting in high elution efficiency and smooth flow which in turn provides easy control and a stable operation.

In eluting the resin, it is desirable to achieve the maximum elution of uranium with a minimum volume of eluant. This increases the concentration of the uranium in the pregnant eluant, now called eluate, thereby making it easier to recover the uranium from the eluate and, also, cuts down on the problems normally associated with the handling, disposal, etc. of large volumes of eluate and barren eluant, now called decant solution.

In the present invention, the total quantity of the selected acid (i.e. $H^+$ in milliequivalents/gram of loaded resin) may be determined by loading a bead of quaternary amine resin with uranyl carbonate complex from a carbonate leach solution representative of that to be used in the actual leach operation and then titrating the loaded bead with the selected acid to a pH level (e.g. from 2 to 4) required for subsequent precipitation of the uranium values from the eluate without any significant additional pH adjustment being required. After the quantity of acid required to elute all of the resin in column 10 (see FIG. 1) is known, it is desirable to supply this quantity of acid in the least practical volume of eluant.

To do this, the acid should be supplied to the resin in its most concentrated form but in known commerical operations that is usually impractical. That is, it may be possible to concentrate all of the required acid ($H^+$) in a volume of eluant equivalent to only one bed volume or less of the resin in column 10. However, due to the flow characteristics through a resin column, e.g. channelling, etc., such a small quantity of eluant would not physically contact all of the resin beads on a single pass. Therefore, the required acid may be supplied through column 10 by injecting the most concentrated acid as a slug and flushing this acid slug out of column 10 with a carrier fluid, e.g. water or decant solution, or the required acid may be mixed into a carrier fluid, e.g. water or an aqueous solution of sodium chloride (NaCl) to form the acidic eluant.

Another way of determining the amount of acidic eluant necessary to elute the loaded resin in column 10 is to monitor the pH of the eluate as it flows out of column 10. This can be done by positioning a pH probe in line 15 and connecting it to an appropriate metering means 25. During elution of uranyl carbonate complexes from the resin, the pH of the eluate will continue to decrease. When the pH of the eluate drops below 2, the elution of the resin will be complete and the flow of acidic eluant is ceased.

Due to the size and construction of column 10, the actual resin used, the degree of loading, the acid selected, and other considerations, the actual make-up of eluants used in different leach operations may vary. However, the eluant used in the present invention will preferably have an acid concentration of 1 N or higher.

For a typical, well loaded quaternary amine resin, approximately 5–6 bed volumes of an acidic eluant having a 1 N acid concentration will elute the resin compared to the approximately 10–12 bed volumes normally required when a carbonate eluant is used to elute the same resin.

In the present invention, the $CO_2$ generated by elution is vented from the top of column 10 through line 14 and can be reused in the leach operation, if desired. By flowing the eluant upward in column 10 and constructing column 10 so it is effectively open at its top, the generation of carbon dioxide in the elution step does not create the problems previously believed to exist in the art. A more detailed discussion of the lack of ill effects due to $CO_2$ generation will be set forth below.

As illustrated in the figure, the acidic eluate, now carrying the eluted uranyl cations, flows from near the top of column 10 through line 15. In the preferred embodiment of the present invention, the selected acid is hydrochloric acid and the acidic eluate is flowed into tank 16 where an oxidant, e.g. hydrogen peroxide, is added through line 17 to oxidize the uranyl cations in the eluate from $UO_2$ to $UO_4$. The eluate and oxidized uranyl cations therein then flow through line 18 into tank 20 where the pH of the total eluate is finely adjusted to a determined pH (e.g. 2 to 4) by adding a hydroxide compound, preferably sodium hydroxide, through line 20. Upon adjustment of the pH, the uranium will precipitate from the eluate as uranyl peroxide, commonly called "yellowcake" and is removed through line 21. The actual precipitation steps just described are known in the art and, in and of themselves, form no part of the present invention.

However, as the sodium hydroxide reacts with the hydrochloric acid in tank to precipitate the uranium values from the eluant, sodium chloride and water are formed so that the decant solution which flows from tank 19 through line 22 is comprised of an aqueous sodium chloride (NaCl) solution in addition to some other minor impurities. In a commercial operation, a portion of this decant solution can be recycled and used as the carrier fluid for the acid in making up fresh eluant.

In the present acid elution process, NaCl in the eluant is considered beneficial and since the $Cl^-$ ions from both the hydrochloric acid and from the NaCl solution operate on the favorable and necessary mechanisms of elution steps as follows:

$$R_4UO_2(CO_3)_3+4Cl^- \rightleftharpoons R_4Cl_4+UO_2(CO_3)_3^{-4} \quad (2)$$

As seen by this reaction, the $Cl^-$ displaces the uranyl carbonate complex ion (i.e. $UO_2(CO_3)_3^{-4}$) which diffuses from the resin beads. In the second step, the uranyl carbonate complex ion then reacts with the proton, i.e. $H^+$, outside the bead as follows:

$$UO_2(CO_3)_3^{-4}+6H^+ \rightarrow UO_2^{+2}+3CO_2\uparrow+H_2O \quad (3)$$

Further, as seen from equation (2), the resin will exist after elution in the form of $R_4Cl_4$ which experiments now prove is an excellent form for loading uranyl carbonate complexes from a carbonate leach solution. Accordingly, there is no need to treat the resin after elution prior to the next loading cycle. Consequently, it is desirable to maintain the level of free NaCl as high as possible to improve elution. The actual concentration of NaCl permissible in a particular leach operation will be dictated by both physical considerations (e.g., too high a density of NaCl makes up-flow elution difficult) and chemical considerations (e.g., formation of $UO_2Cl_4^-$ which is difficult to elute and which possibly may contaminate the precipitated yellowcake). Therefore the chloride content of the eluant should be controlled to below 1.5 N and preferably at about 1.1 N. Chloride concentrations above 2 N decrease the extent of elution, perhaps due to formation of $UO_2Cl_4^{-2}$, which adsorbs strongly on the resin.

In the present invention, the chloride content of the eluant is preferably controlled by taking a bleed stream from the decant solution through line 23 and passing it to waste pit 24 or the like. The bleed stream through line 15 is sized to remove sufficient NaCl from the recycle circuit so that when concentrated acid is added through line 13 to the decant solution, the resultant fresh eluant has an acid concentration of 1 N or greater and a NaCl concentration of less than 1.5 N.

Although, as explained above, hydrochloric acid is preferred, other acids can be used in the present invention. For example, sulfuric acid is a good acidic eluant but the sulfate ion may cause some problems in certain precipitation schemes used to recover the uranium values from the eluate.

From the above, it can be seen that there is provided a method of direct acid elution of a resin loaded with uranyl carbonate complexes which requires no pre- or post-treatment of the resin. This is contrary to the previous, commonly held belief in the art that direct acid elution would disrupt column operations and rupture the resin bead. This belief was apparently based on the fact the $CO_2$ is generated in direct acid elution and if the rate of $CO_2$ generation inside the resin beads is faster than the rate of diffusion of $CO_2$ out of the beads, an explosion of the beads will occur. However, a careful analysis based on experimental work now shows that, unexpectedly, the rate of $CO_2$ production cannot be too rapid inside the beads. For production of $CO_2$ inside the beads, acid, i.e. $H^+$, must first diffuse into the beads before it can react with the carbonate complex. In the beads, the Donnan potential (barrier) is set up to keep the $H^+$ (co-ion) from diffusing into the beads freely, resulting in a slow production of $CO_2$. In fact, a substantial amount of the $CO_2$ generated is produced outside the beads by acid decomposition of the uranyl carbonate complexes which has been exchanged out of the beads by the $Cl^-$ ion and/or other anions according to equation (2). To substantiate this finding the following experiments were conducted.

In one experiment, IRA 430 resin was repeatedly exchanged with 1 molar $Na_2CO_3$ to convert it to the carbonate form. Resin, weighing 3.06 grams, was contacted with 45 ml of 1 normal HCl, and the volume of $CO_2$ evolved was measured as a function of time. The initial rate of reaction over the first 100 sec. was $8.5\times10^{-2}$ cc ($CO_2$)/sec-g. Based on the reactions of equations (2) and (3) above, the diffusivity of the uranyl carbonate complexes required to generate $CO_2$ at the above mentioned reaction rate can be calculated to be $1.2\times10^{-5}$ cm$^2$/sec. This is the order of magnitude of the diffusivity of gases and liquids in liquids at 25° C. (e.g., $CO_2$ in $H_2O=1.96\times10^{-5}$ cm$^2$/sec). These calculations indicate that diffusion of uranyl carbonate complex ions from the beads is the rate determining step, and this slow rate of $CO_2$ evolution prevents rupture of the beads.

In another experiment, twenty cc. of IRA 430 resin was converted alternately between carbonate and chloride forms in a batch reactor using 1 molar $Na_2CO_3$ and 1 molar HCl, respectively, for 10, 20 and 30 cycles. The resin was compared with the original, control resin by visual inspection. The results showed no indication of beam breakage at all.

The foregoing description of this invention has been directed to particular details in accordance with the requirements of the Patent Act and for purposes of explanation and illustration. It will be apparent, however, to those skilled in this art that many modifications and changes may be made without departing from the scope and spirit of the invention. It is further apparent that persons of ordinary skill in this art will, on the basis of this disclosure, be able to practice the invention within a broad range of process conditions. It is my intention in the following claims to cover all such equivalent modifications and variations as fall within the true scope and spirit of my invention.

What is claimed is:

1. A method for recovering uranium values from a carbonate leach solution comprising:

flowing said carbonate leach solution containing said uranium values through a column of a basic, anionic exchange resin to exchange said uranium values onto said resin;

ceasing the flow of said carbonate leach solution when said column of said resin is sufficiently loaded with said uranium values;

directly eluting said column of said resin without pretreatment of said resin by flowing a concentrated acidic eluant through said column of said resin to exchange said uranium values from said resin, said eluant comprising hydrochloric acid and further comprising sodium chloride in a concentration of less than 1.5 normal;

ceasing the flow of said concentrated acidic eluant when said uranium values have been exchanged from said column of resin; and again flowing said carbonate leach solution containing said uranium values through said column of said resin to exchange said uranium values onto said resin without treatment of said resin after said eluting.

2. The method of claim 1 wherein said basic, anionic exchange resin is a quaternary amine resin.

3. The method of claim 2 further comprising:

determining when said uranium values have been exchanged by monitoring the pH of said concentrated acidic eluant after it passes through said column of said resin, and ceasing the flow of said concentrated acidic eluant when said pH of said monitored eluant drops below a value of 2.

4. The method of claim 2 wherein said concentrated acidic eluant is flowed upward through said column of said resin.

5. The method of claim 2 wherein said acidic eluant is flowed downward through said column of said resin.

6. The method of claim 1, 2, 3, 4 or 5 wherein the concentration of acid in said acidic eluant is about 0.01 normal or greater.

7. The method of claim 1, 2, 3, 4 or 5 wherein the concentration of acid in said acidic eluant is about 0.1 normal or greater.

8. A method for recovering uranium values from carbonate leach solution comprising:

flowing said carbonate leach solution containing said uranium values through a column of a basic, anionic exchange resin to exchange said uranium values onto said resin;

ceasing the flow of said carbonate leach solution when said column of said resin is sufficiently loaded with said uranium values;

determining the amount of acid required to elute said uranium values from said column of said resin;

directly eluting said column of said resin without pretreatment of said resin by flowing an eluant through said column of said resin to exchange said uranium values from said resin, said eluant comprising said required amount of acid, said acid being concentrated hydrochloric acid, and said eluant further comprising sodium chloride in a concentration of less than 1.5 normal;

ceasing the flow of said eluant when all of said required amount of acid has been flowed through said column of resin; and again flowing said carbonate leach solution containing said uranium values through said column of said resin without treatment of said resin after said elution.

9. The method of claim 8 wherein said direct elution step comprises:

flowing said required amount of acid through said column of said resin as a slug; and flushing said slug of said acid from said column of said resin by flowing a carrier fluid therethrough.

10. The method of claim 9 wherein said carrier fluid comprises water.

11. The method of claim 8 further comprising:

treating the eluate from said column of said resin to precipitate said uranium values therefrom, said treating comprising oxidizing said uranium values in said eluate; and adjusting the pH of the eluate to a value between 2 to 4 by adding sodium hydroxide, whereby a precipitate of said uranium values and a decant solution of sodium chloride and water are formed.

12. The method of claim 8, 9, 10 or 11 wherein said acidic eluant is flowed downward through said column of said resin.

* * * * *